US006017129A

United States Patent [19]

Krietzman

[11] Patent Number: 6,017,129

[45] Date of Patent: Jan. 25, 2000

[54] SWITCHABLE TAIL-CAP ILLUMINATOR WITH POWER SUPPLY

[76] Inventor: Mark Howard Krietzman, P.O. Box 3185, Palos Verdes Estates, Calif. 90274

[21] Appl. No.: 09/123,704

[22] Filed: Jul. 27, 1998

[51] Int. Cl.[7] ..... F21L 7/00

[52] U.S. Cl. ..... 362/184; 362/194; 362/196; 362/202

[58] Field of Search ..... 362/184, 191, 362/194, 196, 198, 202, 203, 205, 207, 208

[56] References Cited

U.S. PATENT DOCUMENTS

| | | | |
|---|---|---|---|
| 1,816,065 | 7/1931 | Weidman . | |
| 2,538,332 | 1/1951 | Schaefer | 362/184 |
| 2,716,700 | 8/1955 | France . | |
| 2,900,494 | 8/1959 | Cheng . | |
| 4,228,484 | 10/1980 | Johnstone | 362/184 |
| 5,558,430 | 9/1996 | Booty, Jr. | 362/184 |
| 5,909,952 | 6/1999 | Guthrie et al. | 362/205 |

*Primary Examiner*—Cassandra Spyrou
*Assistant Examiner*—Mark A. Robinson
*Attorney, Agent, or Firm*—Mark Krietzman

[57] ABSTRACT

A novel switchable tail-cap illuminator with power supply which adds onto, or replaces a standard tail cap at the end of a flashlight and provides a secondary illumination source, with switchable separate power supply for independent use or for simultaneous illumination with the flashlight.

18 Claims, 3 Drawing Sheets

SWITCHABLE TAIL-CAP ILLUMINATOR WITH POWER SUPPLY

RELATED APPLICATIONS

The within invention is related to applicant's applications: "LASER LIGHT", filed Aug. 21, 1997, Ser. No. 08/918,514, "SECONDARY POWER SUPPLY FOR USE WITH HANDHELD ILLUMINATION DEVICES" filed Mar. 10, 1998, Ser. No. 09/038,726 now U.S. Pat. No. 5,909,062, and "MULTI-FUNCTION SWITCHING HEAD FOR USE WITH HANDHELD ILLUMINATION DEVICES" filed Jul. 11, 1998, Ser. No. 09/114,424.

BACKGROUND OF THE INVENTION

1. Field of the Invention

This present invention relates to a novel switchable secondary illumination source nested within a tail-cap for use with a flashlight or illuminator such as those disclosed in applicant's related applications Ser. Nos. 08/918,514, 09/038,726, and 09/114,424, and more particularly to a novel switchable tail-cap illuminator with its own power supply which may be added to an existing flashlight.

2. Background

The benefits of a back-up illumination source nested within a flashlight are plentiful, a red-LED allows for the night-reading of maps, without reducing night vision as is the case with full spectrum illumination. Additionally, should the primary power supply fail, or the primary illumination source fail, the secondary illumination source could be used. Those acquainted with underwater or emergency situations will recognize the associated benefits of having selectable secondary illumination sources with a separate power supply, should said first source fail. Additionally, having a dual illumination source may be useful in lighting dual areas at the same time such as a pathway and the area remotely in front.

The "Dual Beam Flashlight" taught by U.S. Pat. No. 5,558,430 issued to Booty provides a dual beam flashlight with two power supplies and dual switches with the secondary illumination source a integral part of the flashlight casing. The power supply is also housed only within the main flashlight housing and is not a module or add-on unit.

None of the solutions provide a modular self-powered tail-cap illuminator or a separate which replaces a standard flashlight tail-cap with a switchable secondary illumination source.

SUMMARY OF INVENTION

Accordingly, it is an object of the invention to provide a novel separately powered switchable illuminator within a tail-cap for use with flashlights and illuminators.

It is yet another object of the invention to provide a novel secondary illuminating tail-cap which may be added to an existing flashlight to provide a reading light, beacon or pathway light.

It is yet another object of the invention to provide a novel tail-cap which provides a secondary illumination source and power supply which may be added to an existing flashlight.

The features of the invention believed to be novel are set forth with particularity in the appended claim. The invention itself, however, both as to configuration, and method of operation, and the advantages thereof, may be best understood by reference to the following descriptions taken in conjunction with the accompanying drawings.

MODES FOR CARRYING OUT THE INVENTION

Figure 1A:
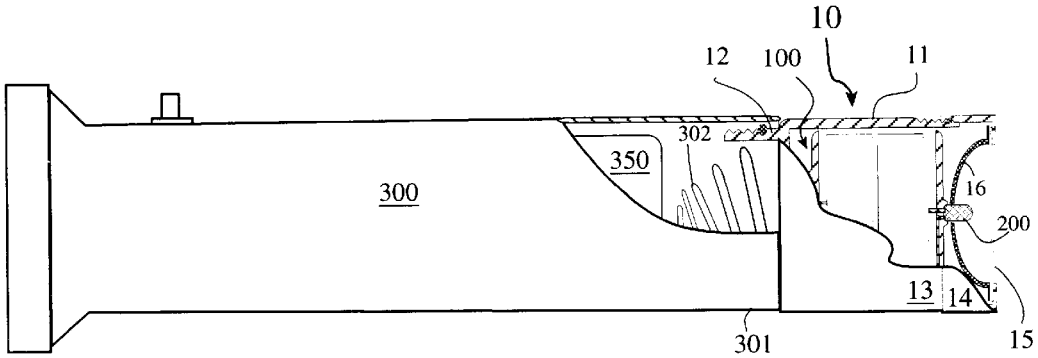
FIG. 1A illustrates a partially cut-away side view of the preferred embodiment of the tail-cap illuminator with power supply mounted on a flashlight.

Referring now to the drawings, there is illustrated in FIG. 1A a partially exploded side view of a handheld flashlight 300 with the preferred embodiment of the tail-cap illuminator generally designated 10, attached thereto.

The tail-cap illuminator screws into the threaded tail-cap receiving back end 301 of a flashlight 300. The tail-cap illuminator is of a size and shape to replace an existing flashlight tail-cap and has a generally cylindrical casing 11, with a sealed back end 12 and an open head receiving front 13. Within the cylindrical casing 11 a roughly cylindrical battery carriage 100, which provides electrical current for the tail-cap illuminator 10 (which is similar to that secondary battery carriage detailed in applicant's related application Ser. No. 09/038726 entitled "Secondary Power Supply For Use With Handheld Illumination Devices"), is insertable into the cylindrical casing 11 through the open head receiving front 13. A light emitting diode 200 with switchable electrical contacts is affixed to the battery carriage 100. A cover 14 with a protective lens 15 mates removably with the cylindrical casing 11. To hold the secondary battery carriage 100 in place a parabolic reflecting dish 16, which also collimates and direct the output of the light emitting diode 200, is placed over the light emitting diode and beneath the cover 14. When the tail-cap illuminator 10 is mounted to a flashlight 300 it replaces a standard tail-cap. A large spring 302 mounted to the rear of the sealed back end 12 of the tail-cap illuminator 10 protrudes into the flashlight 300 and seats against the flashlight battery supply 350 to complete the electrical circuit within the flashlight.

Figure 1B:
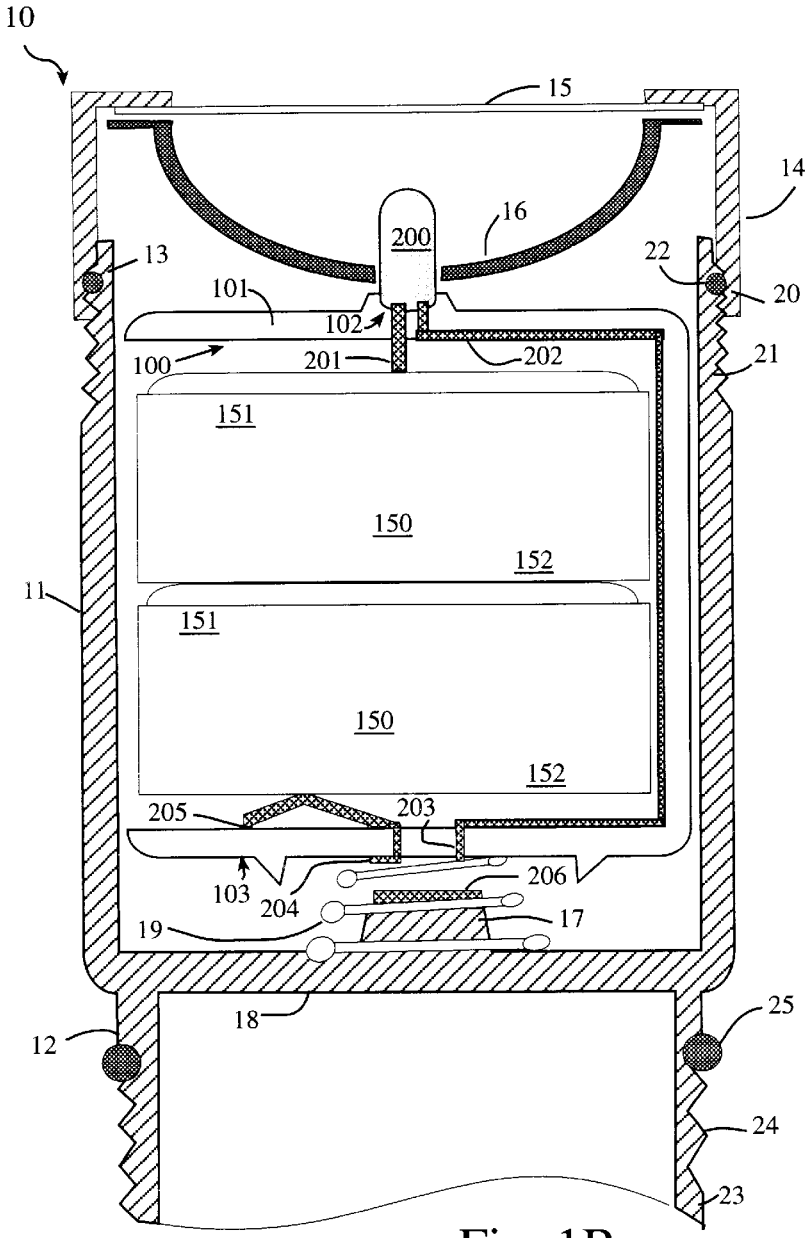
FIG. 1B illustrates a cut-away view of the preferred embodiment in the "off" position.

Referring now FIG. 1B, there is illustrated a cut-away view of the preferred embodiment in the "off" position, generally designated 10.

Formed at the front face 101 of the secondary battery carriage 100 is a LED mounting guide 102 whereby the light emitting diode 200, with a positive 201 and a negative 202 lead wire may be affixed. The positive lead wire 201 is connected to the positive terminal 151 of the battery power supply 150 and the negative lead wire 202 passes around the inside surface of the battery carriage 100 and extends through the rear wall 103 terminating on the exterior surface of the battery carriage 100, to form the first switch contact 203.

Also extending through the through the rear rall 103 and terminating on the exterior surface of the battery carriage 100, is the second switch contact 204 which forms a spring conductive contact which both connect to the negative terminal 152 of the battery power supply 150 and holds the battery power supply 150 in battery carriage 100.

To direct the output from the light emitting diode 200, a parabolic reflecting dish 16, which fits over the light emitting diode 200, and behind the protective lens 15, is mounted within the cylindrical casing 11 through the head receiving front 13. To seal the tail-cap illuminator 10 the head cover 14 with a protective lens 15 affixed within mates to the head cover receiving front 13.

To supply current form the battery power supply 150 to switch "on" the tail-cap illuminator 10 the first switch contact 203 and the second switch contact 204 must be connected, whereby the negative terminal 152 of the secondary battery power supply and the negative terminal 152 are conductively linked.

Figure 1C:
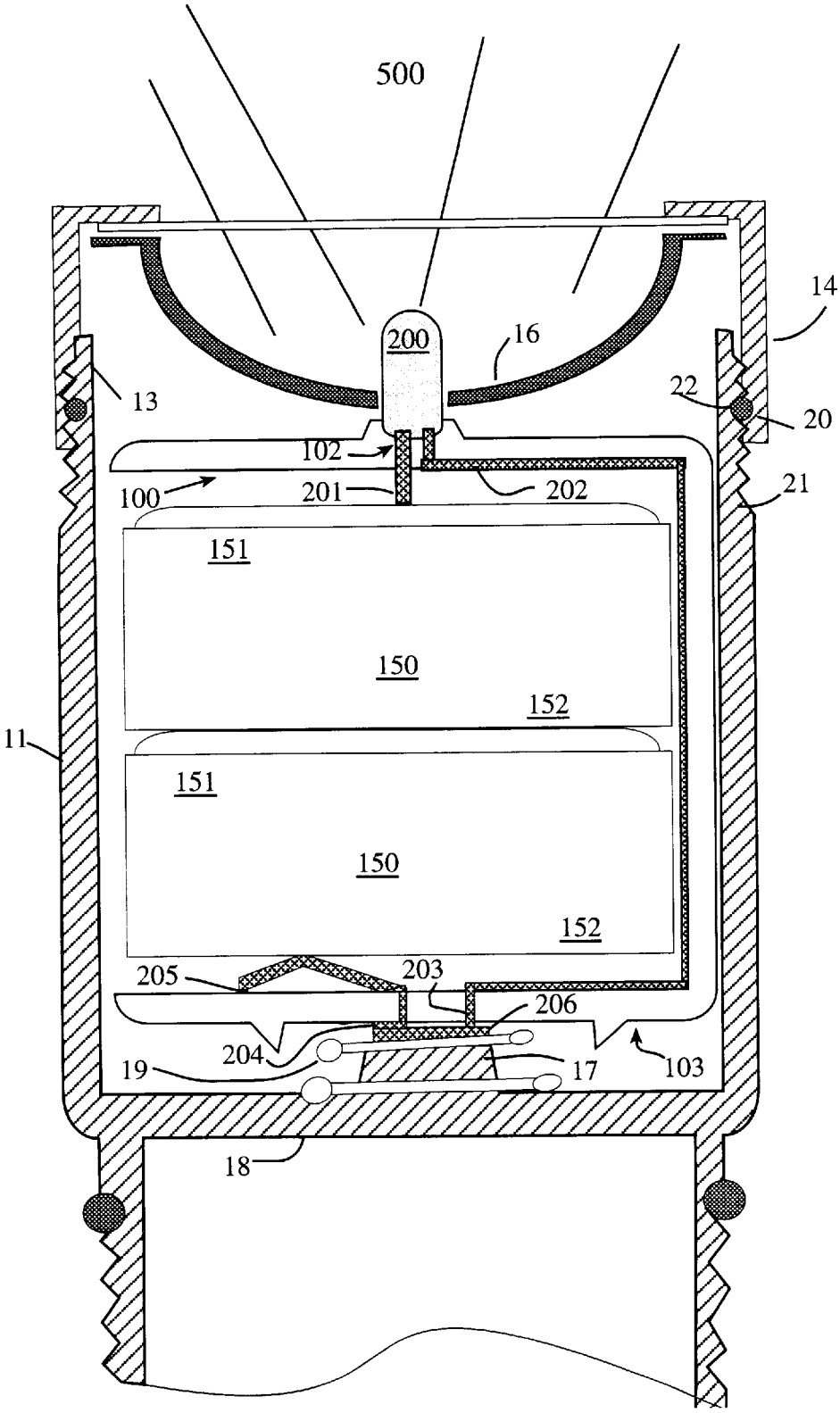
FIG. 1C illustrates a cut-away view of the preferred embodiment in the "on" position.

Referring now FIG. 1C, there is illustrated a cut-away view of the preferred embodiment in the "on" position, generally designated 10.

In the shown configuration both the first switch contact 203 and the second switch contact 204 extending from the rear wall 103 of the secondary battery carriage 100, are seated upon the connecting plate 206 thereby closing the circuit and providing electrical current to the light emitting diode 200 and the light emitting diode 200 is producing the light output 500. To switch the electrical current "off", the head cover 14 is turned counter-clockwise and the expanding coil spring 19 separates the first switch contact 203 and the second switch contact 204 from the connecting plate 206.

Figure 1D:
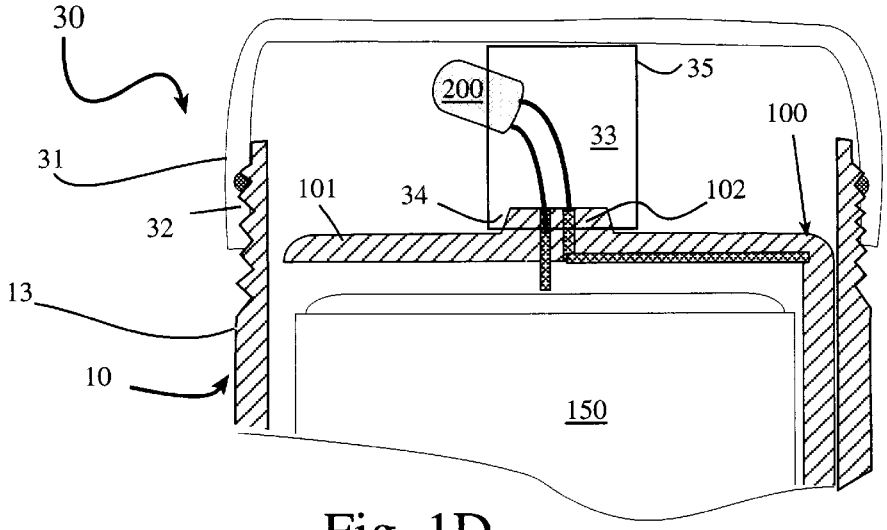
FIG. 1D illustrates a cut-away component view of an alternate embodiment of the head cover.

Referring now FIG. 1D, there is illustrated a cut-away component view of an alternate embodiment of the head cover generally designated 30.

In the shown configuration the head cover 31 is a single transparent lens with internal threads 32 which mates with the externally threaded head receiving front 13 of the cylindrical casing 11. Affixed to LED mounting guide 102 is the angular LED extension 33, via its guide mounting bottom edge 34 the light emitting diode 200 is affixed within the angular LED extension 33 to direct its output to one side. It is envisioned that a parabolic reflecting dish may be added around the light emitting diode 200 to further direct and collimate the output from the light emitting diode 200.

To switch the light emitting diode 200 "on" the head cover 31 is screwed onto the head receiving front 13 and presses down against the top edge 35 of the angular LED extension 33, whereby the battery carriage 100 is moved linearly within the cylindrical casing 11 causing the coil spring 19 which separates the first switch contact 203 and the second switch contact 204 to compress and seating the first switch contact 203 and the second switch contact 204 on the connecting plate 206.

Figure 1E:
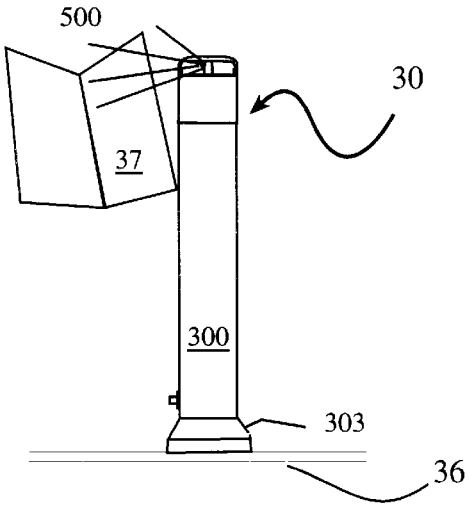
FIG. 1E illustrates a side view of the embodiment in FIG. 1D, used as a reading lamp.

Referring now FIG. 1E, there is illustrated a side view of the embodiment in FIG. 1D, used as a reading lamp.

The flashlight 300 with tail-cap illuminator 10 with the transparent head cover 31, is illustrated using the front end 303 of the flashlight 300 as a base resting on a planar surface such as a table 36. The light output 500 is directed at a book 37.

Figure 1F:
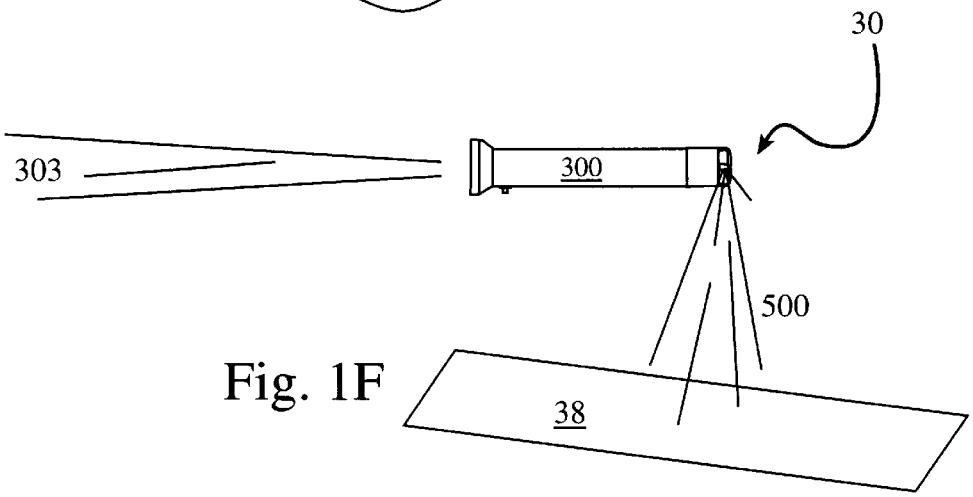
FIG. 1F illustrates a illustrated a side view of the embodiment in FIG. 1D, used to light downward.

Referring now FIG. 1F, there is illustrated a side view of the embodiment in FIG. 1D, used to both light forward and down.

The flashlight 300 with tail-cap illuminator 10 with the transparent head cover 31, is illustrated directed the light output 500 towards a pathway 38 and the flashlight output 303 forward.

Since certain changes may be made in the above apparatus without departing from the scope of the invention herein involved, it is intended that all matter contained in the above description, as shown in the accompanying drawing, shall be interpreted in an illustrative, and not a limiting sense.

What is claimed is:

1. A switchable tail-cap illuminator with power supply, comprising:

(a) a hollow tail-cap with a closed back end and an open front end;

(b) one or more illumination means with positive, and negative lead wires of a size and shape to fit within said hollow tail-cap;

(c) a battery power supply with a positive and negative terminal of a size and shape to fit within said hollow tail-cap and which is switchably connected to said illumination means;

(d) one or more illumination outputs produced by said illumination means;

(e) a substantially clear cover of a size and shape to cover said open front end; and, (f) a means for electrically connecting said battery power supply to said illumination means; and, (g) and a means for removable affixing said tail-cap illuminator to the back of a flashlight.

2. The switchable tail-cap illuminator with power supply, of claim 1 further comprising a parabolic reflecting dish around said illumination means.

3. The switchable tail-cap illuminator with power supply, of claim 1 wherein said illumination output is directed parallel to said hollow tail-cap.

4. The switchable tail-cap illuminator with power supply, of claim 1 wherein said illumination output is directed angularly to hollow tail-cap.

5. The switchable tail-cap illuminator with power supply, of claim 1 wherein said electrical connecting means is selected from the group of on/off switches consisting of momentary, push button, pressure sensitive, rotating, rotating momentary, variable resistance switches consisting of rotating, pressure sensitive, or momentary rotating.

6. The switchable tail-cap illuminator with power supply, of claim 1 wherein said illumination means is selected from the group consisting of diode-pumped, CW diode, Q-switched diode, solid-state, solid-state CW, solid-state Q-switched, or rare-earth element lasers.

7. The switchable tail-cap illuminator with power supply, of claim 1 wherein said illumination means is selected from the group consisting of Halide bulbs, Xenon bulbs, Krypton bulbs, Tungsten bulbs, full spectrum light emitting diodes or spectrum specific light emitting diodes.

8. The switchable tail-cap illuminator with power supply, of claim 1 wherein said battery power supply is selected from the group consisting of lithium batteries, zinc-air batteries, silver batteries, "AAAA" dry-cell batteries, "AAA" dry-cell batteries, "AA" dry-cell batteries, "C" dry-cell batteries, "N" dry-cell batteries, "D" dry-cell batteries, rechargeable batteries.

9. The switchable tail-cap illuminator with power supply, of claim 1 wherein said switching means further comprises:

(a) a externally threaded outwardly protruding cylindrical neck around said open front, forming a clear cover receiving end;

(b) a series of internal threads formed inside said clear cover which mate with said externally threaded outwardly protruding cylindrical neck;

(c) a roughly half cylindrical non-conductive battery carriage with a roughly circular front and rear of a size and shape to allow removable insertion of said battery power supply;

(d) a mounting guide formed on said circular front whereby said illumination means may be directly affixed to said battery carriage;

(e) a contact head formed externally on said circular rear with first, and second connecting terminals;

(f) a first conductive strip connecting said positive battery supply terminal to said positive lead wire of said illumination means;

(g) a second conductive strip connecting said negative battery supply terminal to said second connecting terminal;

(h) a conductive spring removably affixing said battery power supply within said battery carriage and connecting said negative battery supply terminal to a third connecting terminal;

(i) a parabolic reflecting dish placed around said illumination means, with an extend edge seated against said cover;

(j) a conductive switching contact affixed to said closed back end and facing said open front end open; and, (k) a non-conductive spring interposed between said conductive switching contact and said circular rear, whereby the screwing on of said cover over said externally threaded outwardly protruding cylindrical neck causes said battery carriage to move linearly and compress said non-conductive spring thereby seating said third and second connecting terminals on said conductive switching contact and switching "on" said battery power supply to said illumination means.

10. The switchable tail-cap illuminator with power supply, of claim 9 further comprising a rubber or silicone rubber "O" ring interposed between said externally threaded outwardly protruding cylindrical neck and said cover whereby a watertight seal between said cover and said externally threaded outwardly protruding cylindrical neck is formed.

11. The switchable tail-cap illuminator with power supply, of claim 1 further comprising a large conductive spring affixed to the closed back end and an extended threaded mating neck of a size and shape to replace a tail-cap affixed to the end of a flashlight.

12. The switchable tail-cap illuminator with power supply, of claim 1 wherein the means for removably affixing said tail-cap illuminator to the back of a flashlight is a cup shaped catch, whereby a flashlight's back end may be removable inserted.

13. A switchable tail-cap illuminator with power supply, comprising:

(a) a hollow elongated casing having a sealed rear end and being substantially circular in cross-section with a threaded outwardly protruding cylindrical neck forming a cover receiving front end and a cylindrical flashlight receiving back end;

(b) a threaded clear cover which mates with said clear cover receiving front end;

(c) a sealant means disposed between said clear cover receiving front end and said clear cover providing a watertight seal;

(d) a series of batteries with a positive and a negative terminal mounted within a battery carriage, which fits within said hollow elongated casing;

(e) a light emitting diode with a first and second lead wire affixed to said battery carriage and oriented within said clear cover;

(f) a illumination output produced by said light emitting diode;

(g) a first contact strip connecting said batteries positive terminal to said light emitting diodes first lead wire and a second contact strip connecting said batteries negative terminal to a switching head formed on said battery carriage;

(h) a third contact strip connecting said batteries negative terminal to said switching head formed; and, (i) a switching means for conductively connecting said second and said third contact strips, whereby current is supplied to said light emitting diode.

14. The switchable tail-cap illuminator with power supply, of claim 13, wherein said switching means is a rotating switch, whereby the rotation of said clear cover causes said battery carriage to align said second and said third contact strips thereby supplying current to said light emitting diode.

15. The switchable tail-cap illuminator with power supply, of claim 14 wherein said rotating switch further comprises a conductive plate mounted within said elongated casing and aligned with, yet remote from, said third and said second contact strips, whereby the rotation of said battery carriage may rotationally seat said third and said second contact strips on said conductive plate.

16. The switchable tail-cap illuminator with power supply, of claim 14 wherein said rotating switch further comprises:

(a) a conductive plate mounted within said elongated casing and aligned with, yet remote from, said third and said second contact strips; and, (b) a non-conductive spring mounted within said elongated casing which separates said second and said third contact strips from said contact plate whereby the screwing on of said cover to said outwardly protruding cylindrical neck causes said battery carriage to move substantially linearly within said casing and compress said non-conductive spring thereby seating said second and said third contact strips said conductive plate.

17. The switchable tail-cap illuminator with power supply, of claim 14 further comprising a large conductive spring affixed to the sealed rear end and an extended threaded mating neck of a size and shape to replace a tail-cap affixed to the end of a flashlight.

18. The switchable tail-cap illuminator with power supply of claim 13 wherein said flashlight receiving back end is a cup shaped catch whereby a flashlight's back end may be removably inserted.

* * * * *